US006968764B2

(12) United States Patent
Gorun et al.

(10) Patent No.: US 6,968,764 B2
(45) Date of Patent: Nov. 29, 2005

(54) BLADE CLEANER FOR A CONTINUOUS LOOP BLADE ON A FOOD SLICING MACHINE

(75) Inventors: John B. Gorun, Canal Winchester, OH (US); David S. Rauch, Lancaster, OH (US)

(73) Assignee: J. E. Grote Company, Columbus, OH (US)

( * ) Notice: Subject to any disclaimer, the term of this patent is extended or adjusted under 35 U.S.C. 154(b) by 136 days.

(21) Appl. No.: 10/647,021

(22) Filed: Aug. 21, 2003

(65) Prior Publication Data

US 2005/0039587 A1 Feb. 24, 2005

(51) Int. Cl.[7] ..... B26D 7/08
(52) U.S. Cl. ..... 83/168; 83/100
(58) Field of Search ..... 83/100, 168, 788–820

(56) References Cited

U.S. PATENT DOCUMENTS

| | | | | |
|---|---|---|---|---|
| 659,088 | A * | 10/1900 | McKenzie | 83/168 |
| 1,861,412 | A * | 5/1932 | Oliver | 83/24 |
| 1,870,774 | A * | 8/1932 | Gaines | 83/168 |
| 1,908,727 | A * | 5/1933 | Bleam | 83/168 |
| 2,741,281 | A * | 4/1956 | Braun | 83/168 |
| 3,669,163 | A * | 6/1972 | Crane | 30/380 |
| 3,760,715 | A | 9/1973 | Grote et al. | |
| 4,312,253 | A * | 1/1982 | Johnson et al. | 83/167 |
| 4,318,323 | A * | 3/1982 | Voorhees et al. | 83/168 |
| 4,372,185 | A * | 2/1983 | Pila | 83/101 |
| 4,436,012 | A | 3/1984 | Hochanadel | |
| 5,031,497 | A * | 7/1991 | Moshier et al. | 83/168 |
| 5,235,885 | A * | 8/1993 | Camarena et al. | 83/146 |

FOREIGN PATENT DOCUMENTS

WO WO 00/59691 10/2000

* cited by examiner

*Primary Examiner*—Allan N. Shoap
*Assistant Examiner*—Carolyn Blake
(74) *Attorney, Agent, or Firm*—Jason H. Foster; Kremblas, Foster, Phillips & Pollick

(57) ABSTRACT

A cleaning device for a continuous loop band blade food processing machine. A pair of scrapers is positioned on, and seated against, opposite sides of the blade for scraping matter from the blade as it passes between the scrapers. The scrapers are biased against the blade. The upper scraper has an axis that is transverse to the blade's axis, and the blade can be removed by loosening the screw attaching the upper scraper and pivoting the scraper about the screw. The edge of the upper scraper is transverse to the blade's axis to cause scraped matter to flow toward a deflector panel that guides air and scraped matter into a vacuum inlet which is positioned near the edges of each scraper.

29 Claims, 3 Drawing Sheets

BLADE CLEANER FOR A CONTINUOUS LOOP BLADE ON A FOOD SLICING MACHINE

BACKGROUND OF THE INVENTION

1. Field of the Invention

This invention relates generally to food slicing machines, and more specifically to a cleaning apparatus for cleaning the continuous loop blade of a food slicing machine.

2. Description of the Related Art

Food slicing machines, such as those shown in U.S. Pat. No. 3,760,715 to Grote et al. and U.S. Pat. No. 4,436,012 to Hochanadel, use a continuous loop blade, in the manner of a bandsaw, to slice food products, such as meats, cheeses and vegetables. The blade is a razor-sharp metal band that extends in a loop around a drive wheel and an idling guide wheel, and extends through a blade guide positioned between the wheels. The blade guide maintains the position of the blade relative to the food product to permit very accurate slicing. The food product is held in a carriage, such as a tube with an open bottom, that is reciprocated through a path that includes the blade to form slices of food during each cycle. The food slices formed fall downwardly onto a conveyor or other surface, and the food product slides downwardly in the carriage during the tube's travel in the opposite direction of the cycle.

During the slicing of food products, water is conventionally sprayed onto the blade to lubricate it. This water and any food residue on the blade can form a mixture that can create problems if it is left on the blade. If it is not cleaned off the blade, the mixture can fall down onto food slices or the conveyor on which the food slices fall, or it can be flung by centrifugal force from the drive or guide wheel onto the machine's housing or any nearby object.

Conventionally, the method of cleaning this residue includes dismantling the machine and hand or spray cleaning. This requires substantial effort and time during which the machine is not slicing food. Furthermore, without frequent cleaning, one cannot be certain whether the residue will find its way onto food product. If this residue falls onto the food product, it produces an undesirable product both in taste and appearance.

Therefore, the need exists for an apparatus for effectively cleaning the blade of a food slicing machine without the need to take the machine out of useful service.

BRIEF SUMMARY OF THE INVENTION

The invention is a cleaning apparatus mounted to a food slicing machine. The food slicing machine has a frame and a continuous loop blade drivably mounted to the frame. The blade has opposing first and second major surfaces and an axis.

The cleaning apparatus includes a body mounted to the frame. The body preferably has a channel through which a portion of the blade extends. A first scraper has a first end mounted to the body in the channel. A second end of the first scraper extends in the manner of a cantilever away from the first end and terminates in an edge seated against the first surface of the blade for scraping matter from the blade.

A second scraper has a first end that is removably mounted to the body. Preferably, the removable mounting is by a fastener extending through an aperture in the first end of the second scraper and into the body. This fastener preferably attaches at a point positioned laterally of the blade's axis and the longitudinal axis of the second scraper is transverse to the blade's axis, so that the second scraper can be easily moved out of the way for blade removal. The second scraper terminates in an edge at a second, opposite end seated against the second surface of the blade for scraping matter from the blade.

A conduit is mounted to the body at an aperture in the body that forms an inlet. The inlet opens into the channel adjacent at least one of the scrapers. The conduit has a passageway extending from the inlet to a pump for pumping air past the scrapers and into said inlet and sucking matter scraped from the blade by the scrapers into the inlet.

In a preferred embodiment, a deflecting panel is mounted to the body adjacent the inlet. A gap is formed between the deflector and the scrapers. The deflecting panel extends at least partially around the scrapers for deflecting matter scraped from the blade into the inlet.

Figure 1:
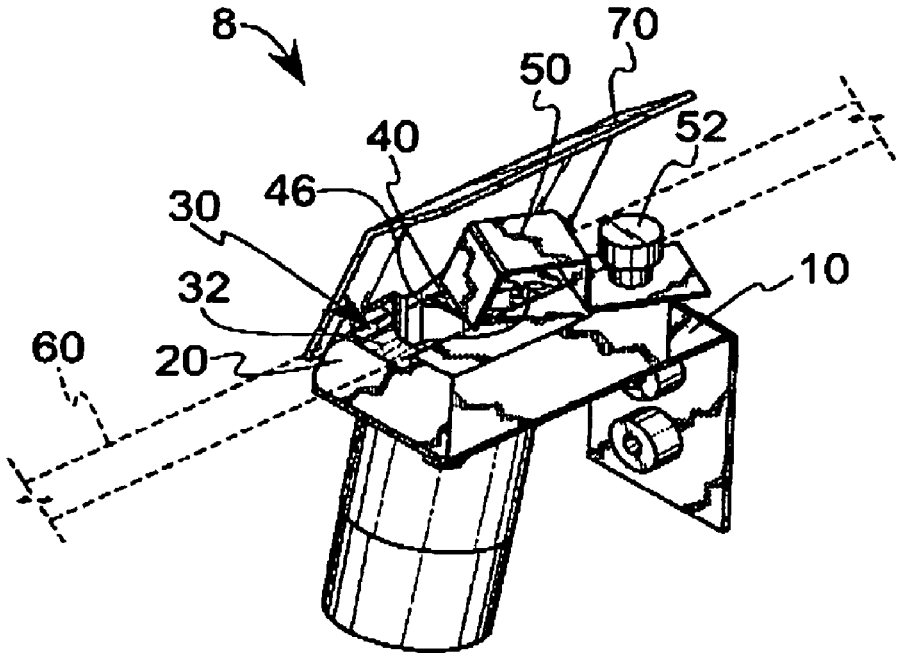
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word "connected" or terms similar thereto are often used. They are not limited to direct connection, but include connection through other elements where such connection is recognized as being equivalent by those skilled in the art.

DETAILED DESCRIPTION OF THE INVENTION

Figure 2:
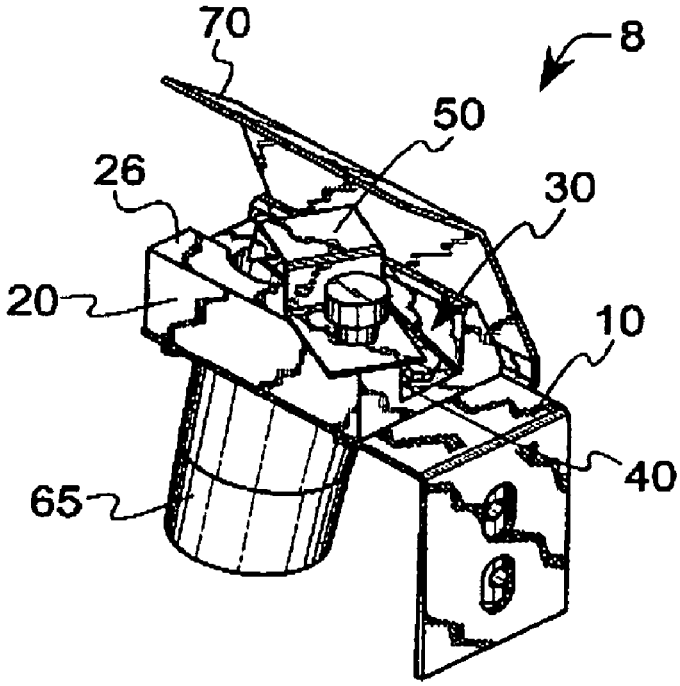
FIG. 2 is another view in perspective illustrating the preferred embodiment of the present invention.

The preferred embodiment of the present invention, the cleaning apparatus 8, is shown in FIGS. 1 and 2. The cleaning apparatus 8 has a bracket 10 which enables the cleaning apparatus 8 to be mounted to the frame of a food processing machine, preferably a food slicing machine such as those shown in U.S. Pat. No. 3,760,715 to Grote et al. and U.S. Pat. No. 4,436,012 to Hochanadel, which are incorporated herein by reference. The food slicing machine uses a band blade to slice food products, including logs of meats and cheeses and other food products, into slices. The bracket 10 is preferably stainless steel, but could be made of other materials as will be understood by the person of ordinary skill from the present description. The cleaning apparatus 8 is mounted to the frame of the food slicing machine in a region where the band blade is accessible, because the cleaning apparatus 8 is positioned around the band blade as described below.

Figure 3:
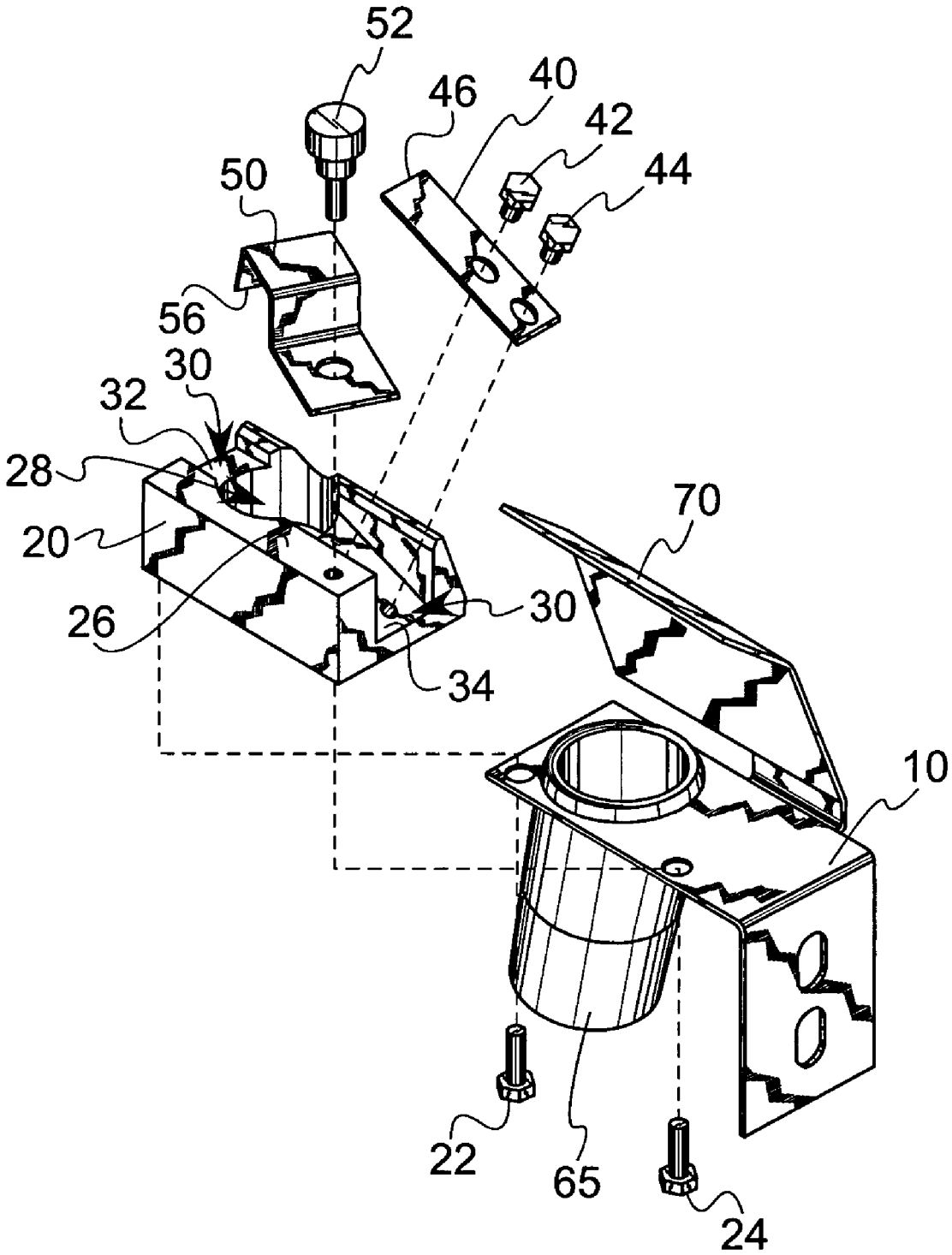
FIG. 3 is an exploded view in perspective illustrating the preferred embodiment of the present invention.

The body 20 is rigidly mounted to the bracket 10 by a pair of screws 22 and 24, which extend through apertures in the bracket 10 and into threaded bores formed in the underside of the body 20, as shown in FIG. 3. The body 20 is preferably an ultra high molecular weight polymer, such as is sold under the trademark DELRIN, but could be any suitable material.

The body 20 preferably has a channel 30 formed in its top region, in the orientation shown in FIGS. 1 to 3, and the channel 30 extends the entire length of the body 20. The channel 30 has a blade-supporting floor 32 at one longitudinal end, and an inclined, scraper-supporting floor 34 at the opposite end. The purposes of these floors will become apparent from the description below.

There is a lower, elongated scraper 40 mounted to the body 20 in and parallel to the channel 30. The scraper 40 seats at its underside against the inclined, scraper-supporting floor 34. The screws 42 and 44 extend through longitudinally slotted apertures formed in one end of the scraper 40 and are tightly threaded into threaded bores formed in the body 20, as shown in FIG. 3, to seat against the scraper 40 and fix the scraper 40 in place relative to the body 20. The slotted apertures in the scraper 40 facilitate longitudinal adjustment of the scraper 40 by merely loosening the screws 42 and 44 slightly, displacing the scraper 40 longitudinally, and then re-tightening the screws 42 and 44. The scraper 40 extends from its first end along the inclined floor 34, and its second end extends above the aperture 28 formed through the body 20 in the manner of a cantilever. The terminal edge 46 of the scraper 40 is positioned over the aperture 28.

The upper scraper 50 is removably mounted to the upper surface 26 of the body 20 by the screw 52 extending through an aperture formed at one longitudinal end of the scraper 50 and into a threaded bore formed in the body 20 at the surface 26. The term "removably mounted" indicates the ability of the scraper 50 to be completely removed from the body 20, but also includes the ability to loosen the scraper 50 from its fixed position and move the scraper 50 by hand to another location, such as just laterally by pivoting about the screw 52.

Opposite the end to which the screw 52 is mounted, the scraper 50 has a substantially planar end region that forms an angle 57 (see FIG. 5) of approximately 70 degrees to the band blade 60. This substantially planar end region terminates in an edge 56, which faces the edge 46 of the lower scraper 40, and is positioned over the aperture 28. It is preferred that there be either no gap between the edges 46 and 56, or a very small gap no greater than the thickness of the blade that will be cleaned by the cleaning apparatus 8.

The scrapers 40 and 50 and their mounting screws are preferably made of stainless steel, although other materials could be used with corresponding advantages and/or disadvantages. Additionally, the terms "upper" and "lower" used herein to modify the words "scraper" describe the positions of the scrapers when the cleaning apparatus 8 is in the preferred operable position. These terms do not exclude the possibility that the scrapers could be reversed, or that the cleaning apparatus described herein could be used in another orientation. Indeed, such modifications are contemplated, and will be recognized by the person of ordinary skill from the description herein as alternatives to those shown and described.

Figure 4:
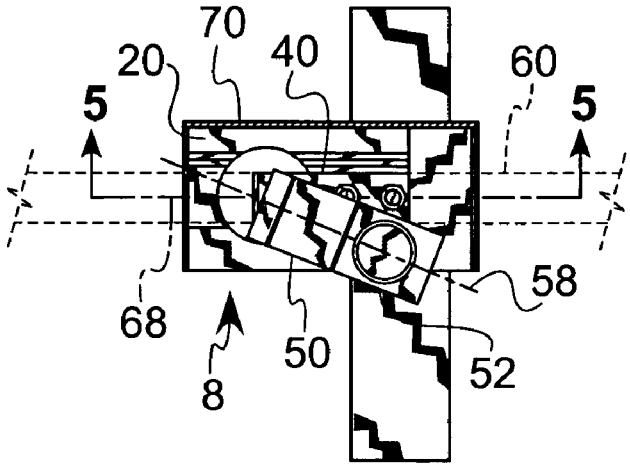
FIG. 4 is top view illustrating the preferred embodiment of the present invention in an operable position.

The band blade 60 is shown in phantom in FIG. 4 when the cleaning apparatus 8 is in its operable position shown in FIG. 1. The band blade 60 forms a continuous loop, typically around spaced wheels, and is curved at regions upstream and downstream (relative to the direction of movement of the blade 60) of the cleaning apparatus 8. Between the curved regions, the band blade extends along a substantially straight line to form a planar section extending through the channel 30 in the body 20.

The band blade 60 has first and second opposing major surfaces, and extends between the edges 46 and 56 of the scrapers 40 and 50, respectively, in the channel 30. Because of the very small or nonexistent gap between the edges 46 and 56, the scrapers 40 and 50 must be bent slightly away from the band blade 60 to insert the blade 60 therebetween. It is preferred that the gap be smaller than the thickness of the band blade 60, which is typically approximately 0.020 inches, so that there is a slight bending of the scrapers 40 and 50 to accommodate the band blade 60. The scrapers 40 and 50 spring back only partially, that is, until the edges 46 and 56 seat against the opposing major surfaces of the band blade 60. The edges 46 and 56 are thus biased against the opposing surfaces of the band blade 60 because of the partially bent scrapers. The bias keeps the edges 46 and 56 in contact with the blade's surfaces during any variations in blade position, and maintain the scrapers 40 and 50 in contact with the blade 60 at all times during operation. The amount of force the scrapers apply to the blade 60 can be adjusted by displacing the scraper 40 longitudinally as described above, and by bending the scraper 50 toward or away from the blade 60.

The band blade 60 seats against or is held near the blade-supporting floor 32, which limits the lower position of the band blade 60 in the channel 30 as shown in FIG. 4. The blade-supporting floor 32 restricts downward movement of the band blade 60 during operation, and the lateral sidewalls of the channel 30 restrict lateral movement of the blade 60 during operation. The scrapers 40 and 50 seating on opposite sides of the blade 60 also restrict upward and downward movement of the blade 60, but will flex slightly to accommodate such movement.

Because the scrapers 40 and 50 seat against the blade 60 while the blade 60 is displaced rapidly (approximately 30 feet per second) between the scrapers, the edges 46 and 56, which may be ground down slightly to conform to the shape of the blade 60, scrape and remove the small bits of fat, meat, cheese, vegetable or other substances on the blade 60, including water that is commonly used to lubricate the blade 60. Once removed, this matter is sucked into the aperture 28, which forms an inlet into the vacuum system.

The vacuum system, which is not illustrated due to the fact that it is a conventional food processing vacuum system, includes a pump that draws air at high speed and with large volume flow per unit time, through the pipe 65 attached to the bracket 10 and in fluid communication with the aperture 28. Because the aperture 28 has an upper end forming an inlet that is adjacent to each scraper's edge, the air that is sucked past the scraper edges 46 and 56 pulls any water and other matter removed from the blade 60 into the aperture 28.

The pipe 65, which is preferably an integral part of the bracket 10 by welding or any other attachment, has a passageway that is in fluid communication with the pump, and therefore a pressure differential is created between the pipe interior and the atmosphere. The matter removed from the blade has fluid properties that permit it to flow, and as matter is removed from the band blade, it is directed toward the aperture 28. The waste matter is thereby sucked into the pipe 65 through the aperture 28. After it is drawn into the pipe, the matter is deposited in waste containers.

Figure 5:
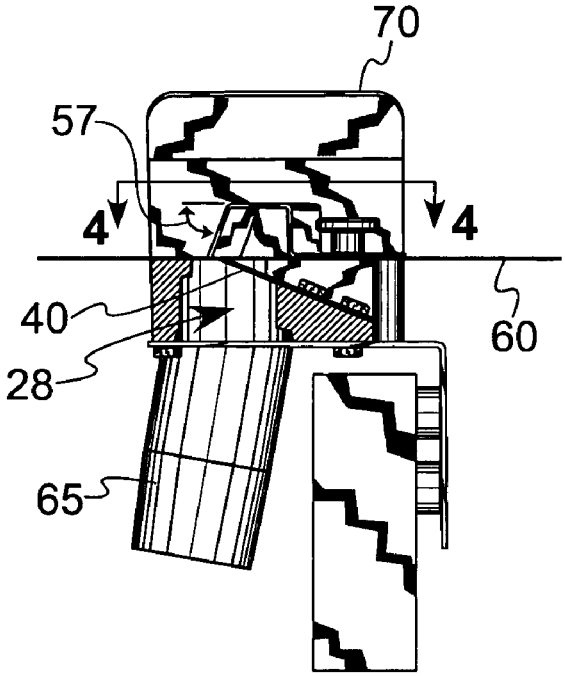
FIG. 5 is a side view illustrating the preferred embodiment of the present invention.

It is preferred that the plane of the lower scraper 40 be transverse to the plane of the blade 60 as shown in FIG. 5, and an angle of approximately 22.5 degrees has been determined to be advantageous. This configuration provides an angle of flow of the matter that is scraped from the underside of the blade 60, which is displaced from left to right in the orientation shown in FIG. 5. The scraped matter flows down the underside of the scraper 40 and into the aperture 28. There is preferably no gap between the underside of the scraper 40 and the body 20 for scraped matter to collect in. Furthermore, because the edge 46 of the scraper 40 is substantially perpendicular to the axis of the scraper 40, the edge 46 is substantially perpendicular to the axis 68 of the blade 60. Thus, matter that is scraped from the blade 60 by the edge 46 flows downwardly by the inertia of the matter as it is removed from the blade 60, by the force due to gravity and by the downwardly directed force of the vacuum into the aperture 28.

The scraper 50 has a longitudinal axis 58 that is shown in FIG. 4. This axis 58 is transverse to the axis 68 of the blade 60, and forms an angle between the axes 58 and 68 that is less than 90 degrees, and about 22 degrees has been determined to be advantageous. Of course, this angle could be greater or less than the preferred angle, depending upon many factors which will be recognized by the person of ordinary skill.

The edge 56 is also preferably substantially perpendicular to the axis 58. Because the edge 56 is substantially perpendicular to the axis 58 in the preferred embodiment, the angle that is formed between the axis 58 and the axis 68 is the same as the angle between the edge 56 and the axis 68. Of course, the edge 56 could be angled relative to the axis 58 so that the edge 56 is perpendicular, or forms a different angle relative, to the axis 68 of the blade 60 like the edge 46 of the scraper 40. However, it is preferred for the edge 56 to be substantially perpendicular to the axis 58 due to the additional advantage that arises from the angle formed between the edge 56 and the axis 68.

The angle between the axis 58 and the axis 68 of the blade 60 results in two advantages. First, the matter that is removed from the blade 60 by the angled edge 56 flows in a preferred direction toward one lateral edge of the blade 60. Unlike the matter that is removed by the scraper 40, which flows downwardly along the scraper's underside and into the aperture 28, the matter that is removed by the scraper 50 cannot flow downwardly or it would return onto the blade 60. Instead, the matter that is removed by the edge 56 flows toward the deflector panel 70 due to the direction of travel of the blade 60 and the angle of the edge 56 relative to the blade's axis 68 as shown in FIG. 4.

Figure 6:
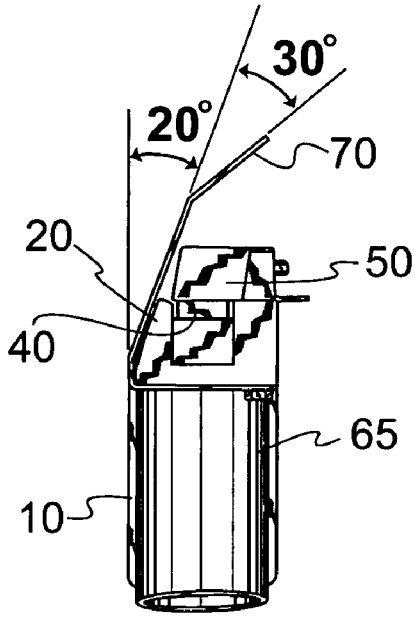
FIG. 6 is an end view illustrating the preferred embodiment of the present invention.

The deflector 70 is preferably integrally formed with the bracket 10 from a single piece of sheet metal, and the deflector 70 is bent along a first line, for example at 20 degrees, and then along a second line, for example at 30 degrees, into the shape shown in FIG. 6. These angles can be varied depending upon the circumstances, or the deflector could simply be curved rather than bent along two lines.

The deflector 70 extends upwardly and over the scrapers 40 and 50 in the operable position shown in FIGS. 5 and 6. Preferably, there is a gap between the scrapers 40 and 50 and the facing surface of the deflector 70 to permit a flow of air past the scrapers 40 and 50 into the aperture 28. Thus, when the matter scraped from the blade 60 flows toward the deflector, the air, and therefore any matter that becomes airborne, is guided by the deflector down toward the aperture 28. The deflector 70 also mechanically guides airborne matter downwardly into the aperture 28 upon impact with the deflector 70. There is substantially no gap between the deflector 70 and the body 20 where the two structures meet to permit scraped matter to collect. Thus, there is a seamless surface down which matter can flow into the aperture 28 from the deflector 70.

The second advantage that is provided by the angle between the axis 58 and the axis 68 of the blade 60 is that the scraper 50 can be easily moved to permit the blade 60 to be removed from the cleaning apparatus 8. The end of the scraper 50 that is opposite the edge 56 is positioned laterally of the axis 68 of the blade 60. The fastener holding the scraper 50 at this end, preferably the screw 52, can be loosened and the edge 56 of the scraper 50 can be simply pivoted laterally away from the blade 60.

The screw 52 can be completely removed, but preferably does not have to be removed, which avoids the possibility of losing the screw 52. By simply loosening the screw 52 and pivoting the scraper 50 about the screw's threaded shaft, the scraper 50 can be moved laterally of the axis 68 of the blade 60, and the blade can then be easily removed from the food processing machine in a conventional manner by rotating the blade about its own axis around the scraper 50 and out from under the deflector 70. Installation is simply the reverse of these steps, in which the blade 60 is rotated into the channel 30 and the scraper 50 is pivoted to positioned its edge 56 against the blade 60 and then the screw 52 is tightened.

A plurality of cleaning apparatuses like the one described above can be positioned at spaced positions along the band blade 60 by connecting each scraper mechanism to a manifold with which the pump is in fluid communication. However, it is also possible to use only one such cleaning apparatus 8, and this cleaning apparatus 8 is preferably mounted to the frame just downstream of the region where the food product is sliced.

While certain preferred embodiments of the present invention have been disclosed in detail, it is to be understood that various modifications may be adopted without departing from the spirit of the invention or scope of the following claims.

What is claimed is:

1. A cleaning apparatus mounted to a food slicing machine having a frame and a continuous loop blade drivably mounted to the frame, the blade having opposing first and second major surfaces and an axis, the cleaning apparatus comprising:

(a) a body mounted to the frame, the body having a channel through which a portion of the blade extends;

(b) a first scraper having a first end mounted to the body in the channel and having a second end extending in the manner of a cantilever away from the first end and terminating in an edge seated against the first surface of the blade for scraping matter from the blade;

(c) a second scraper having a first end that is removably mounted to the body at a point positioned laterally of the blade's axis, and laterally of the blade, the second scraper also having an edge at a second end seated against the second surface of the blade for scraping matter from the blade;

(d) a conduit mounted to the body at an aperture in the body that forms an inlet, said inlet opening into the channel and positioned adjacent at least one of said scrapers, said conduit having a passageway extending from the inlet to fluid communication with a pump for pumping air past the scrapers and into said inlet and drawing matter scraped from the blade by the scrapers into the inlet.

2. The cleaning apparatus in accordance with claim 1, further comprising a deflecting panel mounted to the body adjacent the inlet and extending at least partially around the scrapers for deflecting matter scraped from the blade into the inlet.

3. The cleaning apparatus in accordance with claim 2, wherein a gap is formed between the deflector and said scrapers.

4. The cleaning apparatus in accordance with claim 2, wherein a longitudinal axis of the second scraper is transverse to the blade's axis.

5. The cleaning apparatus in accordance with claim 4, wherein the second scraper's edge seated against the blade is angled less than ninety degrees to the axis of the blade.

6. The cleaning apparatus in accordance with claim 5, wherein the first scraper is substantially planar, and the plane containing the first scraper is transverse to a plane containing the portion of the blade that is in the channel.

7. The cleaning apparatus in accordance with claim 5, wherein the second scraper has at least one substantially planar region adjacent the edge at the second end, and the plane containing that substantially planar section is transverse to the plane containing the portion of the blade that is in the channel.

8. The cleaning apparatus in accordance with claim 5, wherein the first scraper's edge seated against the blade is substantially perpendicular to the axis of the blade.

9. The cleaning apparatus in accordance with claim 5, wherein the first and second scrapers are biased against the blade.

10. The cleaning apparatus in accordance with claim 1, wherein a longitudinal axis of the second scraper is transverse to the blade's axis.

11. The cleaning apparatus in accordance with claim 10, further comprising a deflecting panel mounted to the body adjacent the inlet and extending at least partially around the scrapers for deflecting matter scraped from the blade into the inlet.

12. The cleaning apparatus in accordance with claim 11, wherein a gap is formed between the deflector and said scrapers.

13. The cleaning apparatus in accordance with claim 11, wherein the body has a channel through which a portion of the blade extends, and the inlet opens into the channel.

14. The cleaning apparatus in accordance with claim 13, wherein the second scraper's edge seated against the blade is angled less than ninety degrees relative to the axis of the blade.

15. The cleaning apparatus in accordance with claim 14, wherein the first scraper has a first end mounted to the body in the channel and a second end extending in the manner of a cantilever away from the first end and terminating in the edge seated against the first surface of the blade.

16. The cleaning apparatus in accordance with claim 14, wherein the first scraper is substantially planar, and the plane containing the first scraper is transverse to a plane containing the portion of the blade that is in the channel.

17. The cleaning apparatus in accordance with claim 14, wherein the second scraper has at least one substantially planar region adjacent the edge at the second end, and the plane containing that substantially planar section is transverse to the plane containing the portion of the blade that is in the channel.

18. The cleaning apparatus in accordance with claim 14, wherein the first scraper's edge seated against the blade is substantially perpendicular to the axis of the blade.

19. The cleaning apparatus in accordance with claim 14, wherein the first and second scrapers are biased against the blade.

20. The cleaning apparatus in accordance with claim 1, wherein the body has a channel through which a portion of the blade extends, and the inlet opens into the channel.

21. The cleaning apparatus in accordance with claim 1, wherein the second scraper's edge seated against the blade is angled less than ninety degrees relative to the axis of the blade.

22. The cleaning apparatus in accordance with claim 1, further comprising a fastener extending through an aperture in the first end of the second scraper and into the body at a point positioned laterally of the blade's axis.

23. A cleaning apparatus mounted to a food slicing machine having a frame and a continuous loop blade drivably mounted to the frame, the blade having opposing first and second major surfaces and an axis, the cleaning apparatus comprising:

(a) a body mounted to the frame, the body having a channel through which a portion of the blade extends;

(b) a first scraper having a first end mounted to the body in the channel and a second end extending in the manner of a cantilever away from the first end and terminating in an edge seated against the first surface of the blade for scraping matter from the blade;

(c) a second scraper having a first end that is removably mounted to the body by a fastener extending through an aperture in the first end of the second scraper and into the body at a point positioned laterally of the blade's axis, the second scraper terminating in an edge at a second, opposite end seated against the second surface of the blade for scraping matter from the blade;

(d) a conduit mounted to the body at an aperture in the body that forms an inlet opening into the channel and adjacent at least one of said scrapers, said conduit having a passageway extending from the inlet to a pump for pumping air past the scrapers and into said inlet and drawing matter scraped from the blade by the scrapers into the inlet; and (e) a deflecting panel mounted to the body adjacent the inlet and extending at least partially around the scrapers for deflecting matter scraped from the blade into the inlet; wherein a gap is formed between the deflector and said scrapers.

24. The cleaning apparatus in accordance with claim 23, wherein a longitudinal axis of the second scraper is transverse to the blade's axis.

25. The cleaning apparatus in accordance with claim 24, wherein the second scraper's edge seated against the blade is angled less than ninety degrees relative to the axis of the blade.

26. The cleaning apparatus in accordance with claim 25, wherein the first scraper is substantially planar, and the plane containing the first scraper is transverse to a plane containing the portion of the blade that is in the channel.

27. The cleaning apparatus in accordance with claim 26, wherein the second scraper has at least one substantially planar region adjacent the edge at the second end, and the plane containing that substantially planar section is transverse to the plane containing the portion of the blade that is in the channel.

28. The cleaning apparatus in accordance with claim 27, wherein the first scraper's edge seated against the blade is substantially perpendicular to the axis of the blade.

29. The cleaning apparatus in accordance with claim 28, wherein the first and second scrapers are biased against the blade.

* * * * *